US008047457B2

(12) United States Patent
Hahn et al.

(10) Patent No.: US 8,047,457 B2
(45) Date of Patent: Nov. 1, 2011

(54) JET OUTLET ELEMENT FOR SANITARY FITTINGS

(75) Inventors: Arno Hahn, Schiltach (DE); Joachim Blattner, Haslach (DE); Ulrich Kinle, Schenkenzell (DE); Jochen Armbruster, Wolfach (DE)

(73) Assignee: Hansgrohe AG, Schiltach (DE)

( * ) Notice: Subject to any disclaimer, the term of this patent is extended or adjusted under 35 U.S.C. 154(b) by 452 days.

(21) Appl. No.: 11/719,202

(22) PCT Filed: Nov. 15, 2005

(86) PCT No.: PCT/EP2005/012195

§ 371 (c)(1),
(2), (4) Date: Sep. 26, 2007

(87) PCT Pub. No.: WO2006/050987

PCT Pub. Date: May 18, 2006

(65) Prior Publication Data

US 2008/0073450 A1 Mar. 27, 2008

(30) Foreign Application Priority Data

Nov. 15, 2004 (DE) ..... 10 2004 056 074

(51) Int. Cl.
*B05B 1/14* (2006.01)

(52) U.S. Cl. ..... 239/553.5; 239/589; 239/590; 239/592; 239/597; 239/428.5

(58) Field of Classification Search ..... 239/553–553.5, 239/589–590.5, 592–599, 601, 428.5, DIG. 12
See application file for complete search history.

(56) References Cited

U.S. PATENT DOCUMENTS

| | | | | |
|---|---|---|---|---|
| 1,543,009 | A | 6/1925 | Hedges | |
| 2,900,139 | A | 8/1959 | Hensley, Jr. | |
| 5,249,744 | A * | 10/1993 | Ruthenberg | 239/23 |
| 5,738,280 | A | 4/1998 | Ruthenberg | |
| 6,170,094 | B1 * | 1/2001 | Weise et al. | 4/507 |
| 6,371,392 | B1 | 4/2002 | Steinman | |
| 6,382,520 | B1 | 5/2002 | Hones | |
| 6,450,418 | B1 | 9/2002 | Simpson et al. | |
| 6,578,774 | B1 * | 6/2003 | Noyes | 239/17 |
| 2001/0018776 | A1 * | 9/2001 | Koren et al. | 4/507 |
| 2007/0095933 | A1 * | 5/2007 | Ehresman et al. | 239/18 |

FOREIGN PATENT DOCUMENTS

| | | | |
|---|---|---|---|
| DE | 619110 | B | 9/1935 |
| DE | 25 54 723 | B2 | 6/1977 |
| DE | 26 19 415 | C2 | 1/1986 |
| DE | 100 27 987 | A1 | 12/2001 |
| DE | 202 06 162 | U1 | 9/2002 |
| EP | 0 319 417 | A | 6/1989 |

OTHER PUBLICATIONS

German Search Report; Sep. 20, 2005.
International Preliminary Report on Patentability; May 22, 2007.

* cited by examiner

*Primary Examiner* — Jason Boeckmann
(74) *Attorney, Agent, or Firm* — Duane Morris LLP

(57) ABSTRACT

The invention relates to a jet outlet element for a sanitary fitting which allows outlet of a defined gushing jet from the sanitary fitting. The sanitary outlet element is configured as a flat element having two compartments, a water inlet compartment and a water outlet compartment. A narrowed section is interposed between the two compartments and accommodates a flow rectifier. Said flow rectifier rectifies the as yet non-directional flow of the water in the inlet compartment and guides it in a controlled manner to the outlet compartment from where it emerges through the slotted outlet opening.

10 Claims, 3 Drawing Sheets

JET OUTLET ELEMENT FOR SANITARY FITTINGS

The invention relates to a so-called gushing jet showerhead for sanitary fittings.

Gushing showerheads serve to form a closed, freely falling, wide water jet preferably with a smooth flow.

A known gushing jet showerhead of this kind has a metallic housing that features a circularly cylindrical nozzle on its side for water inlet. The transition into the housing that gradually becomes wider and flatter directly adjoins the connection nozzle. The housing is angular relative to the connection nozzle. In the transition between the connection nozzle and angular housing there are deflectors that divert the incoming water (DE 26 19 415).

Also known is a gushing jet showerhead (DE 25 54 723) with which the one boundary wall of the housing also starts from the connection nozzle and gradually becomes wider and flatter and features a kink.

In all known gushing jet showerheads, it is common that the interior of the housing, starting from the connection nozzle, gradually transforms into a slotted outlet opening. Furthermore, the already known gushing jet showerheads are independent fittings, which are directly connected to a house installation.

There are application cases in which gushing jets should be produced by commercial sanitary fittings.

The task of the invention is to provide a possibility of producing a clean gushing jet even under inconvenient spatial conditions.

To solve this task, the invention proposes a jet outlet element with the features mentioned in Claim 1. This jet outlet element is especially intended as a part of a sanitary fitting meant for producing a gushing jet.

The jet outlet element contains two compartments, thus an inlet compartment in which the water inlet is guided. The jet is released from the jet outlet compartment, whereby also here the water outlet is formed as a slit. There is a flow rectifier between the two compartments, which rectifies the flow of water entering the inlet compartment, and makes it uniform. In this manner, it becomes possible to design the inlet in the inlet compartment independent of whether this is convenient for the formation of a gushing jet. This gives the designer more freedom in the construction of his sanitary fittings, since he can arbitrarily arrange the water inlet.

According to the invention, in a further development of the invention it can be provided that the inlet compartment of the outlet element features a flat rectangular cross-section in the flow direction.

In yet a further development of the invention, it can be provided that the jet outlet compartment features a flat rectangular cross-section in the flow direction. In this manner it is possible, to form the entire jet outlet element as a flat disc-like component that can be installed easily in sanitary fittings.

Both compartments can be located horizontally in the same plane.

In further development of the invention, it can be provided that the jet outlet compartment features a gradually reducing height.

According to a further feature of the invention, the jet outlet element can feature a bottleneck between the inlet compartment and the outlet compartment. The bottleneck can be formed by reducing the height of at least one of the two compartments and/or reducing the width of at least one compartment.

It is particularly convenient if the flow rectifier is located in the area of the bottleneck between the inlet compartment and the outlet compartment.

In order to further improve gushing jet formation, uniformly and optically, a stabilizing zone for the flowing water can be arranged down stream of the flow rectifier according to the invention. In this stabilizing zone, the initially rectified flow of water can once again be stabilized such that an optically appealing flow is achieved.

In particular, it can be provided that the stabilizing zone features a plurality of retarding elements that retard the flow of water.

The retarding elements can extend between the bottom and top of the jet outlet compartment, since the compartment is flat in overall design. For instance, the retarding elements can involve pins with circular cross-section.

The retarding elements can be arranged in at least one row, whereby the row runs transversely to the flow direction, thus parallel to the slit-type outlet opening. In particular it can be provided that die retarding elements are arranged in at least two rows that on the other hand are arranged again on gaps. The water flows around the retarding elements and comes again into a retarding element then flows again into the retarding element around which it flows again.

To ensure uniform distribution of water flow even for a very broad water outlet, it can be provided in a further development of the invention downstream of the flow rectifier and/or of the retarding elements that a flow former be provided. This can for instance comprise several stretched jet forming elements in the flow direction, disposed adjacently to one another, which divide the water flow in individual areas without partitioning these areas from one another.

In yet a further development of the invention, it can be facilitated that the edges of the water outlet run from the jet outlet compartment in one surface aligned obliquely to the flow direction. In particular, it can be facilitated that the one boundary wall of the jet outlet compartment, for instance the top, runs in the area of the water outlet at an angle to the flow direction. The course of this boundary wall located under an angle can be for instance rounded or angled in several steps.

In particular, it can be provided that the top edge of the water outlet is adjustable, for instance, it may be swiveled or displaced. The edges of the water outlet can also be provided with soft lips, whereby an elastomer, rubber or silicone comes in question as material.

According to the invention, the water inlet can be located perpendicularly to the plane of the top or bottom boundary wall of the inlet compartment.

Further features, details, and preferences of the invention are derived from the claims and the abstract, whose wording is based on reference to the content of the description, of the following description of a preferred embodiment of the invention and of the drawing. The figures show:

FIG. 1 shows a side view of a sanitary fitting possibly suitable for a gushing jet showerhead;

FIG. 2 also shows a sanitary fitting likewise suitable for a gushing jet showerhead;

Figure 1:
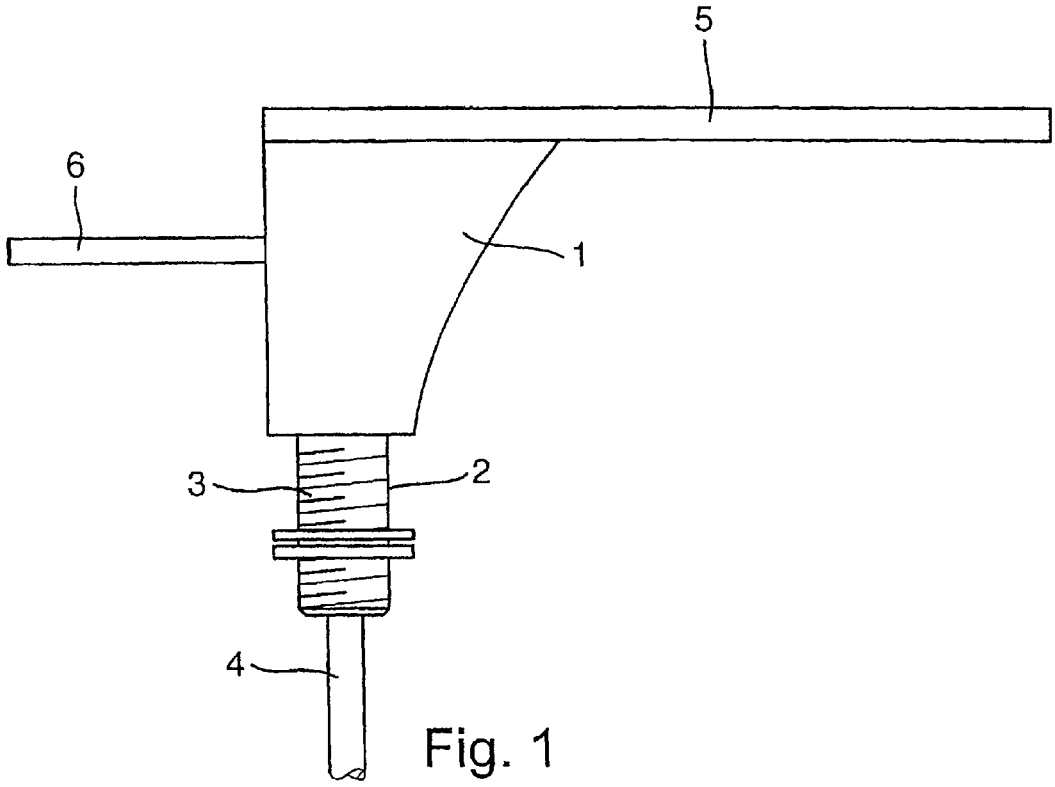
Figure 2:
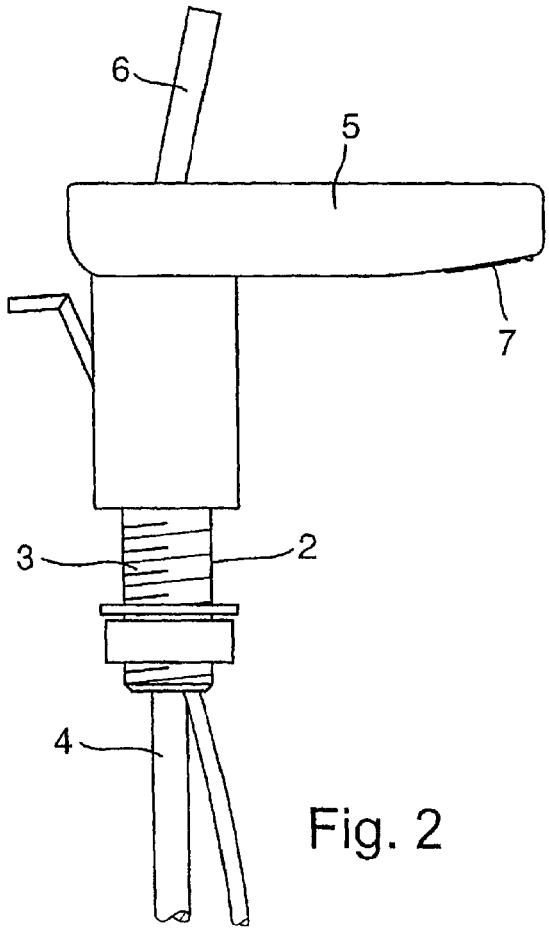

The FIGS. 1 and 2 show possible sanitary fittings that can be attached and used as common sanitary fittings, and which are meant and formed for producing a gushing jet.

The fitting of FIG. 1 contains a fitting housing 1, on whose underside a pipe 3 provided with an external thread 2 is attached. Lines 4 for the fitting pass through the pipe. The pipe 3 is fitted through an opening of a plate and is provided with the depicted nut from beneath. The fitting is fastened on the plate by rotating the nut. On the left side in FIG. 1 an operating element in the form of a bar 6 is present through which the water outlet from the fitting is controlled by swiveling. A run-out housing 5 is attached to the top side of the fitting housing 1, so that it features the form of a flat rectangular plate. From this outlet housing 5, the water should for instance come out of the drawing plane forward as a gushing jet.

The fitting in FIG. 2 features a somewhat more compact outlet housing 5, on whose top side the operating element 6 formed as a rod is disposed. From the outlet housing 5, water in the form of a gushing jet should come out of the still visible outlet opening 7.

Figure 3:
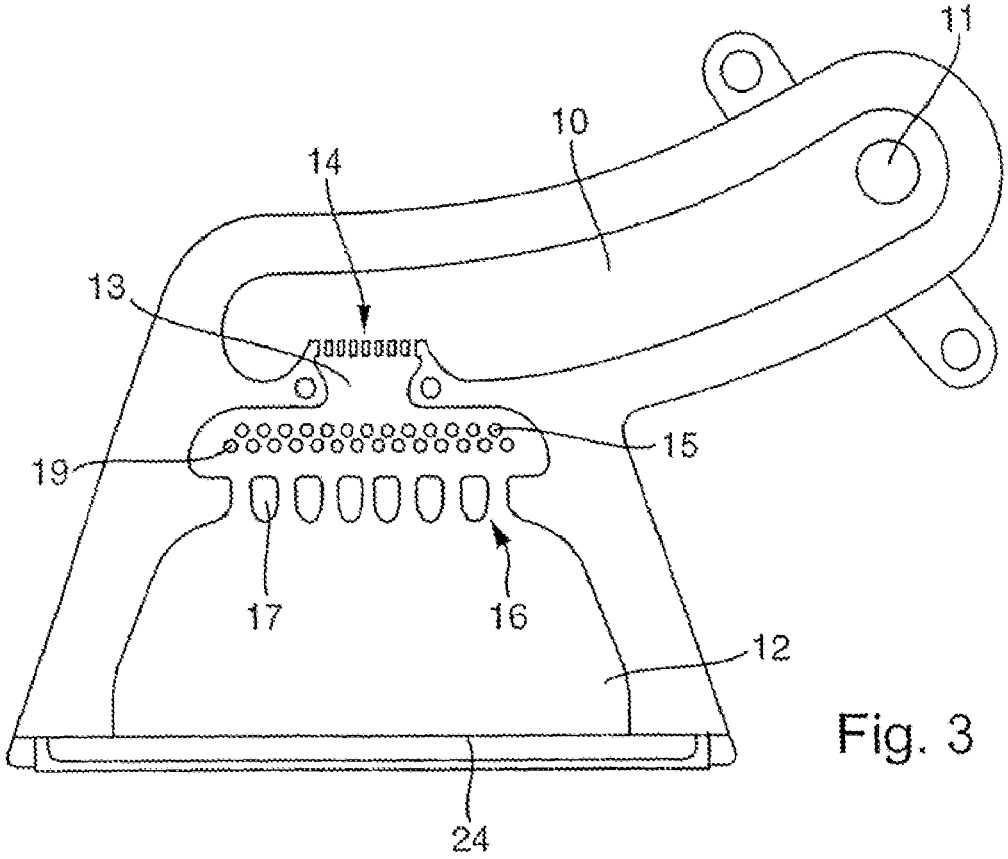
FIG. 3 shows a section through a jet outlet element for a gushing jet shower head.

FIG. 3 depicts a jet outlet element that is meant for installation in the outlet housing 5 of the sanitary fitting according to FIG. 1. The jet outlet element can have the form of a two-part housing, whereby, for instance, FIG. 1 depicts the plan on the section plane between both parts of the housing. The jet outlet element contains an inlet compartment 10, into which the water to be issued flows in through an opening 11. The jet outlet element also contains a jet outlet compartment 12, from which the water is released through an outlet opening 24. A bottleneck 13 is formed between the inlet compartment 10 and the jet outlet compartment 12. The bottleneck 13 is formed through a reduction of the width of the flow cross-section. A flow rectifier 14 is provided directly in front of the bottleneck 13. This contains several short partition walls disposed adjacently, whose longitudinal direction run in the flow direction and parallel to one another. The partition walls extend between the bottom and the top of the inlet compartment 10.

Downstream of the partition point 13 the flow cross-section again enlarges significantly. A stabilizing zone 19 is formed at this point, in which the initially rectified water is stabilized in its flow. This stabilizing zone 19 contains two rows of retarding elements 15 transversely aligned to the flow direction. These retarding elements 15 are small round pins, which stretch between the bottom and the top of the compartment. The retarding elements 15 of each row are disposed equidistantly. The retarding elements 15 of a row are on gaps opposite the retarding elements 15 of the adjacent row.

Downstream of the stabilizing zone 19 formed by the retarding elements 15, a flow rectifier 16 is formed which should then divide the stabilized water into stream filaments. The flow rectifier 16 contains several flow rectifier elements 17, which are somewhat formed as droplets. Its width and distance is substantially greater than the width and distance between the retarding elements 15.

Downstream of the flow rectifier 16 the jet outlet compartment 12 enlarges through an oblique shape of its sidewalls until they reach the water outlet 24.

Through this successive connection of the flow rectifier 14, then of the stabilizing zone 19 and finally of the flow rectifier 16, it is ensured that a gushing jet with can be generated with a defined jet pattern.

Figure 4:
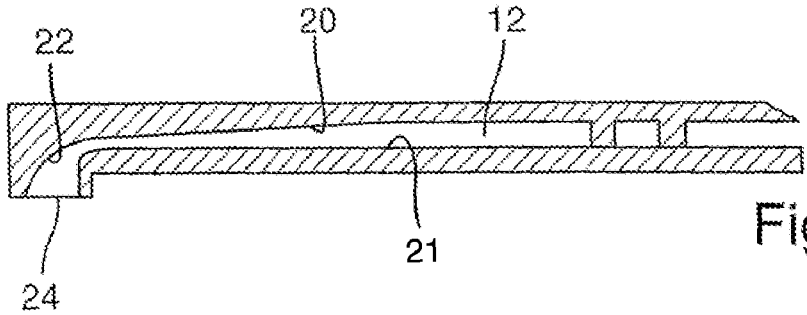
FIG. 4 shows a section through the jet outlet element of FIG. 3.

FIG. 4 shows a partial cross-section through the jet outlet element of FIG. 4. Here one can see that downstream of the flow rectifier 16 the ceiling 20 of the outlet compartment 12 approaches the floor 21, so that the gap between the bottom and top is reduced here. The actual water outlet 24 in form of a slotted opening is in a surface that does not run perpendicular to the flow direction through the outlet compartment 12. The ceiling 20 of the jet outlet compartment runs rather in a curved shape 22, so that the jet is likewise diverted downwards. The orientation of the jet outlet element is thereby assumed, as it appears reasonable for the sanitary fitting of FIG. 1, whereby the term "top and bottom" is defined by the arrangement of the fitting.

FIG. 5 again shows a section through the jet outlet element, and thus through the stabilizing zone with the retarding elements 15.

Figure 5:
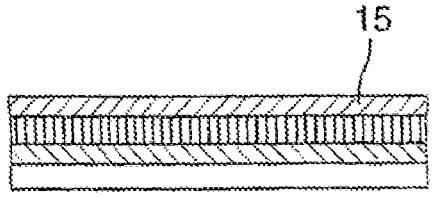
FIG. 5 shows another section through the jet outlet element of FIG. 3.
Figure 6:
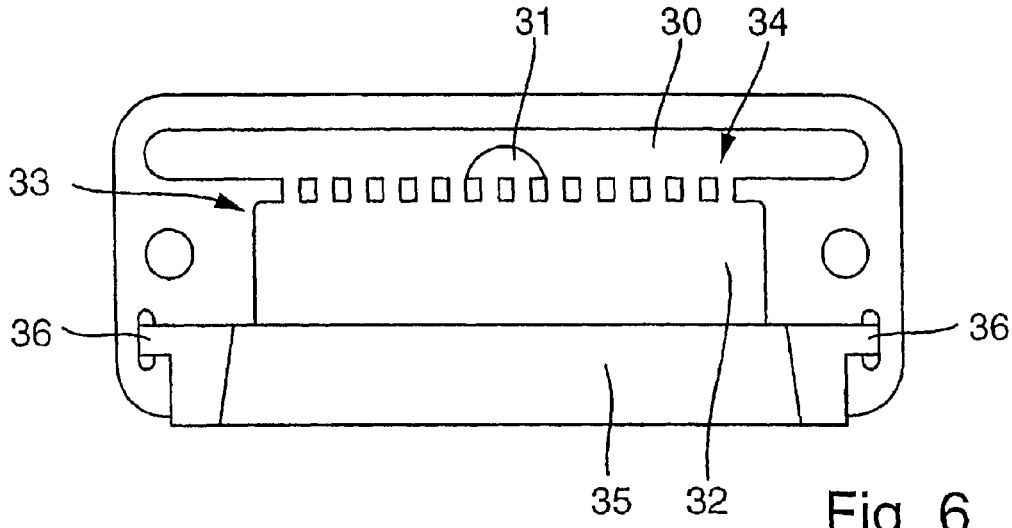
FIG. 6 shows a section or a view through a further jet outlet element.
Figure 7:
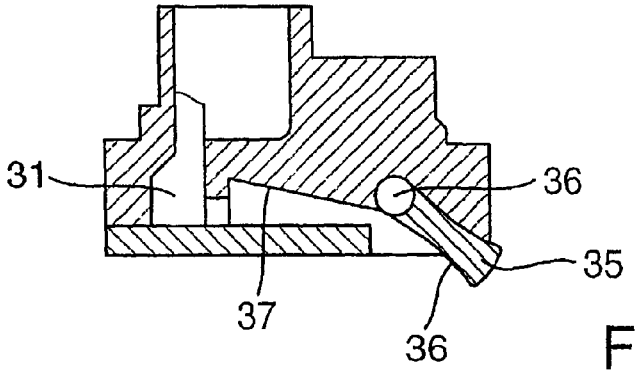
FIG. 7 shows a cross-section through the jet outlet element of FIG. 6.

FIG. 6 now shows an illustration similar to FIG. 3 of a second jet outlet element according to the invention. While the jet outlet element of FIGS. 3 to 5 is meant for the fitting according to FIG. 1, the jet outlet element according to FIGS. 6 and 7 is meant for the fitting according to FIG. 2. Also, this jet outlet element can be designed as an element comprising the bottom and top, so that then FIG. 6 would depict the plan of the partitioning point. FIG. 6 can also be understood as section.

The jet outlet element of FIG. 6 contains a jet inlet compartment 30, into which the water enters through a water inlet 31. This is only illustrated partially. The jet outlet element further contains a jet outlet compartment 32, from which the water can flow out through a slotted outlet opening. Between both compartments 30, 32 a bottleneck 33 is provided, which is now formed through reduction of the height of the compartments, thus, through reduction of the height of the flow cross-section. This can be derived better from FIG. 7. A flow rectifier 34 is disposed in the bottleneck 33, which is similar to the flow rectifier 14 of FIG. 3 as a row of adjacently placed partition walls.

The upper boundary wall of the jet outlet compartment 32 is formed in the area of the outlet opening by a flap 35, which is pivoted with the help of two lateral stub shafts 36. The surface 36 of the flap 35 facing the jet outlet compartment 32 corresponds to the curved shape 22 of the top 20 of the jet outlet compartment 12 in the embodiment according to FIGS. 3 to 5. As one can derive from FIG. 7, this flap 35 can be swiveled through the bearing of the stub shafts 36 in order to be able to adjust the gushing jet. The outside edge of the flap 35 facing away from the stub shafts 36 protrudes somewhat in front of the jet outlet element, so that the user can hold it at that point and swivel the flap.

As one can also derive from the section of FIG. 7, the upper boundary wall 37 of the jet outlet compartment is likewise formed such that here the distance between the bottom and top 37 is reduced in flow direction.

The inlet into the jet outlet element of FIGS. 6 and 7 is provided from a direction transverse to the flow direction; see the section of FIG. 7.

Figure 8:
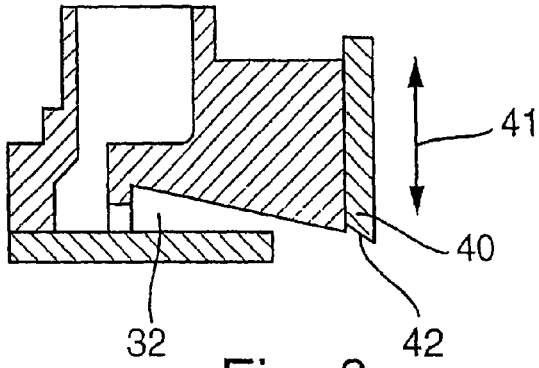
FIG. 8 shows a section corresponding to FIG. 7 with an embodiment modified relative to FIG. 6 and 7, of a jet outlet element according to the invention.

Although the top-edge change of water outlet, targeted by the jet from the outlet compartment 32, occurs by swiveling, according to the embodiment of FIGS. 6 and 7, this top edge shows a possibility of how a change of the position of this edge can occur by displacing an orifice 40 with the help of the flap 35, FIG. 8. This orifice 40 is displaceable in arrangement in the water outlet area, from the jet outlet compartment 32, transversely to the jet outlet direction. The displacement can occur in the double-arrow direction 41. The lower face edge 42 of the orifice 40 is inclined so that when the orifice 40 is displaced in the area of the outlet jet, also the corresponding boundary wall of the jet outlet compartment 32 is angled.

What is claimed is:

1. A jet outlet element for sanitary fittings, comprising:

an inlet compartment, a water inlet leading into the inlet compartment, a jet outlet compartment, a slotted water outlet leading out of the jet outlet compartment, at least one flow rectifier between the inlet compartment and the jet outlet compartment, wherein the inlet compartment defines a flat rectangular cross-section in a flow direction, and the jet outlet compartment defines a flat rectangular cross-section in the flow direction, a bottleneck between the inlet compartment and the jet outlet compartment, a stabilizing zone located downstream in a flow direction of at least one said flow rectifier, wherein the stabilizing zone comprises a plurality of retarding elements, and, wherein the retarding elements are located in at least two rows, and the retarding elements of one of the at least two rows are aligned with gaps between the retarding elements of another of said at least two rows.

2. The jet outlet element according to claim 1, wherein the jet outlet compartment defines a decreasing height in the flow direction.

3. The jet outlet element according to claim 1, wherein the retarding elements extend between a bottom and a top of the jet outlet compartment.

4. The jet outlet element according to claim 1, wherein at least one said flow rectifier is disposed downstream of said stabilizing zone and another said flow rectifier.

5. The jet outlet element according to claim 4, wherein said flow rectifier disposed downstream comprises long-stretched flow rectifier elements elongated in the flow direction.

6. The jet outlet element according to claim 1, wherein edges of water outlets from the jet outlet compartment lie in one surface that runs at an angle to a flow direction.

7. The jet outlet element according to claim 1, wherein a ceiling of the jet outlet compartment in an area of the water outlet is rounded in shape.

8. The jet outlet element according to claim 1, wherein the water inlet is oriented perpendicular to a plane of one of a top limit and a bottom limit of the inlet compartment.

9. The jet outlet element according to claim 5, wherein the long-stretched flow rectifier elements comprise surfaces that are at least partly parallel.

10. The jet outlet element according to claim 5, wherein the long-stretched flow rectifier elements comprise surfaces that are at least partly non-parallel.

* * * * *